US005209997A

United States Patent [19]

Fromm et al.

[11] Patent Number: 5,209,997

[45] Date of Patent: May 11, 1993

[54] THREE ROLL FUSER

[75] Inventors: Paul M. Fromm, Rochester; Rabin Moser, Fairport; James E. Mathers, Rochester, all of N.Y.

[73] Assignee: Xerox Corporation, Stamford, Conn.

[21] Appl. No.: 793,751

[22] Filed: Nov. 18, 1991

[51] Int. Cl.[5] ..... G03G 13/20; G03G 15/20

[52] U.S. Cl. ..... 430/99; 430/124; 355/290

[58] Field of Search ..... 430/99, 124; 219/216, 219/244; 355/290; 432/228

[56] References Cited

U.S. PATENT DOCUMENTS 3,945,726 3/1976 Ito et al. ..... 430/99 X
4,214,549 7/1980 Moser ..... 118/60
4,218,499 8/1980 Shinohara et al. ..... 430/124 X
4,943,831 7/1990 Geraets et al. ..... 355/290
4,977,431 12/1990 Fuji ..... 355/290 X

FOREIGN PATENT DOCUMENTS 184173 10/1983 Japan ..... 355/290
251881 11/1986 Japan ..... 355/290

*Primary Examiner*—Roland Martin

[57] ABSTRACT

A three roll fuser incuding a fuser roll, pressure roll and a backup roll. The backup roll is crowned and is supported in pressure engagement with the fuser roll to form a first nip while the fuser roll is also supported in contact with the pressure roll. The pressure engagement of the crowned roll with the fuser roll eliminates nonuniform nip loading in wide fusers as well as providing uniform velocity through the fuser roll/pressure roll nip.

12 Claims, 1 Drawing Sheet

THREE ROLL FUSER

BACKGROUND OF THE INVENTION

The present invention relates to fuser apparatus for electrostatographic printing machines and in particular to oversized (i.e. wide rolls) roll fusers.

In imaging systems commonly used today, a charge retentive surface is typically charged to a uniform potential and thereafter exposed to a light source to thereby selectively discharge the charge retentive surface to form a latent electrostatic image thereon. The image may comprise either the discharged portions or the charged portions of the charge retentive surface. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface such as plain paper to which it may be permanently affixed by heating or by the application of pressure or a combination of both.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an abhesive material, such as a silicone rubber or other low surface energy elastomer or, for example, tetrafluoroethylene resin sold by E.I. DuPont De Nemours under the trademark Teflon. In these fusing systems, however, since the toner image is tackified by heat it frequently happens that a part of the image carried on the supporting substrate will be retrained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate. In order to prevent this from happening, a release agent application mechanism is utilized.

Wide, small diameter roll fusers inherently suffer from excessive fuser and pressure roll deflection. The load fusers require is a function of speed and type of image to be fused. Color fusers need roughly three times the load a monochrome fuser requires, for a given speed. Bending of a beam, or roller, is inversely proportional to the cube of the length thus, as fuser get wider the rolls bend appreciably more at a given load. Likewise, the bending of a beam with a round cross section, or roller, is directly proportional to the cube of the roll radius. So if it is desired to make the roll a little smaller the deflection increases significantly. The goal in a fuser nip is to produce nearly uniform load across the width. As the roll deflects the load at the ends increase thereby producing paper handing problems, if the load is too nonuniform.

It is known that skewing the fuser roll with respect to the pressure roll will tend to counteract the uneven load distribution caused by roll bending. This occurs because of the wrapping of one roll around the other. However, the resultant shape of the roll is a curve which is a cubic function and it is being wrapped around a circular roll with is a squared function. The resulting load distribution is a maximum about one quarter of the roll length in from each end. You get a "bow tie" nip. Skewing has been successfully employed for fairly stiff systems and very flexible systems. The former needs very little compensation and thus little "bow tie" effect is apparent while the latter requires a lot of skew but the stiffness is low enough that the "bow tie" effect is not visible. Skewing also generates lateral thrust forces that wear the roll surface.

Uneven roll load distribution can also be prevented by crowning one of the two fuser rolls. However, crowning of one of two fuser rolls results in nip velocity problems which induce paper wrinkle.

BRIEF SUMMARY OF THE INVENTION

Briefly, the present invention solves the problem of deflecting rollers by providing a third roll opposite the pressure roll of a two roll fuser. The fuser roll is sandwiched between the "backup roll" and the pressure roll thereby forming a backup roll/fuser roll nip and a fuser roll/pressure roll nip. The backup roll is crowned or larger in the center than the ends to compensate for the bending of all the rolls. The amount of radial increase (crown) is the sum of the defection of the backup roll and the fuser roll/pressure roll combination. The fuser roll and pressure roll share the same deflection so their stiffnesses are added. The fuser roll stiffness is unimportant so it can be made thin and light so it warms up fast and is relatively inexpensive. In a two roll fuser, warm-up time is an outgrowth of the roll mass required for adequate stiffness.

The load is uniform along the length of the rolls in both nips. The speed profile is drastically different because the fuser roll/backup roll nip is formed with a roll of varying surface speed due to radius differences. The fuser roll/pressure roll nip provides constant speed because the rubber strain is uniform and the radius of the roll is uniform. The total size and weight of a fuser is usually an important consideration in design. The relatively wide fuser we designed has lower total height, a considerably narrower profile and weighs significantly less than a two roll fuser with marginal stiffness.

For a better understanding of the present invention, reference may be had to the accompanying drawings wherein the same reference numerals have been applied to like parts and wherein:

DESCRIPTION OF THE PREFERRED EMBODIMENT

Figure 1:
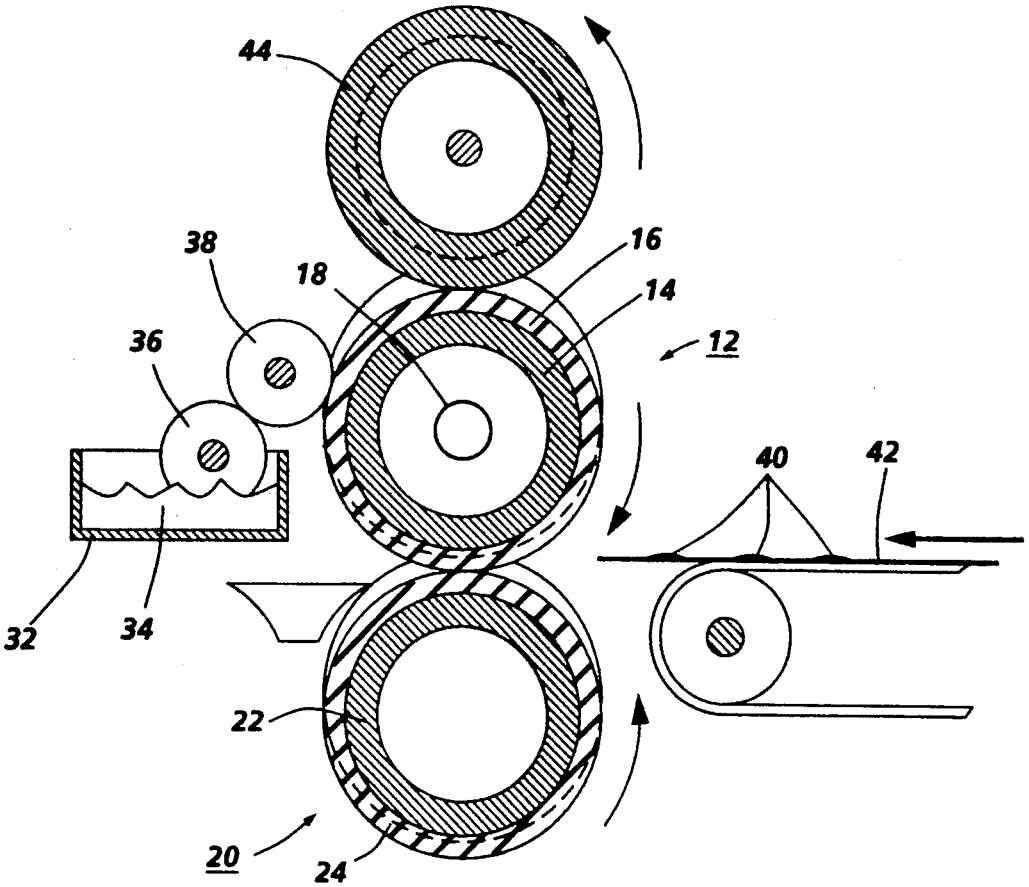
FIG. 1 is aside elevational view of a fuser according to the invention with the fuser rolls thereof shown in cross section taken along the line 1—1 of FIG. 2.
Figure 2:
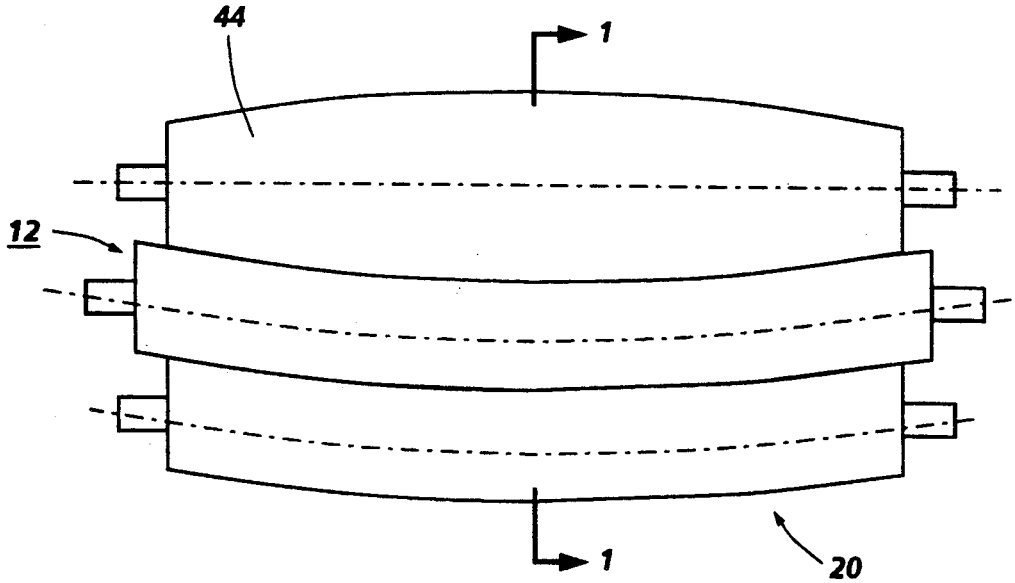
FIG. 2 is a schematic front elevational view of the fuser shown in FIG. 1.

Attention is now directed to FIG. 1 wherein a heat and pressure fuser apparatus and release agent management system therefor are schematically illustrated. As shown in FIG. 1, the fuser apparatus 10 comprises a heated fuser roll 12 which is composed of a core 14 having coated thereon a thin layer 16 of an elastomer. The core 14 may be made of various metals such as iron, aluminum, nickel, stainless steel, etc., and various synthetic resins. Aluminum is preferred as the material for the core 14, although this is not critical. The core 14 is hollow and a heating element 18 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser member can be heated by internal means, external means or a combination of both. Heating means are well known in the art for providing sufficient heat to fuse the toner to the support. The thin fusing elastomer layer may be made of any of the well known materials, for example, RTV and HTV silicone elastomers.

The fuser roll 12 is shown in a pressure contact arrangement with a pressure roll 20. The pressure roll 20 comprises a metal core 22 with a layer 24 of a heat-resistant material. In this assembly, both the fuser roll 12 and the pressure roll 20 are mounted on bearings (not shown). The pressure roll bearings are mechanically loaded, as schematically indicated by the arrows so that the fuser roll 12 and pressure roll 20 are pressed against each other under sufficient pressure to form a nip, not shown. It is in this nip that the fusing or fixing action takes place with toner images contacting the heated fuser roll 12. The layer 24 may be made of any of the well known materials such as fluorinated ethylene propylene copolymer or silicone rubber.

The liquid release agent delivery or management system 30 of the present invention comprises a housing 32 containing release agent material 34, for example, silicone oil. The silicone oil is applied to the surface of the fuser roll 12 via a metering roll 36 and a donor roll 38, the former of which is partially submersed in the silicone oil and contacts the latter for delivering silicone oil thereto. The donor roll roll contacts the fuser roll for applying a thin coating of silicone thereon for preventing offset of toner forming toner images 40 carried by a paper substrate 42. For a more detailed description of the release agent management system reference may be had to U.S. Pat. No. 4,214,549 granted to Rabin Moser on Jul. 29, 1980 which patent is incorporated herein by reference.

The liquid release agent may be selected from those materials which have been conventionally used. Typical release agents include a variety of conventionally used silicone oils including both functional and non-functional oils. Thus, the release agent is selected to be compatible with the rest of the system.

A crowned backup roll 44 is supported in pressure engagement with the fuser roll 12. The fuser roll 12 roll is sandwiched between the backup roll and the pressure roll thereby forming a backup roll/fuser roll nip and a fuser roll/pressure nip. The backup roll is crowned or larger in the center than the ends to compensate for the bending of the fuser and pressure rolls. The amount of radial increase (crown) is the sum of the defection of the backup roll and the fuser roll/pressure roll combination. The fuser roll and pressure roll share the same deflection so their stiffnesses are added. The fuser roll stiffness is unimportant so it can be made thin and light so it warms up fast and is relatively inexpensive. In a two roll fuser, warm-up time is an outgrowth of the roll mass required for adequate stiffness.

By way of example, the fuser and pressure roll lengths are in the order of 24 to 36 inches. Also, by way of example the fuser roll wall thickness is 0.1 inch and has a 1.3 inch diameter thereby providing a fairly low mass fuser roll capable of rapid warmup. The light weight fuser roll is about 10–20% as stiff as the steel pressure roll which has a 2.25 inch diameter and a wall thickness of 0.5 inch. The backup roll and pressure roll have virtually the same construction except that the backup roll has a 0.006 inch radial increase in its middle to provide for the crowing. Thus, the pressure and backup rolls have substantially the same stiffness.

The pressure and fuser rolls are uniform in diameter. The backup roll is loaded to the fuser roll 180° away from the pressure roll. When loaded together, the fuser and pressure rolls bend away from the backup roll and the backup roll bends away from the other two rolls. The radius increase of the backup roll is large enough to follow the deformed shape of the fuser and pressure rolls including the backup roll deflection itself.

The load is uniform along the length of the rolls in both nips The speed profile is drastically different because the fuser roll/backup roll nip is formed with a roll of varying surface speed due to radius differences. The fuser roll/pressure roll nip provides constant speed because the rubber strain is uniform and the radius of the roll is uniform. The total size and weight of a fuser is usually an important consideration in design. The relatively wide fuser we designed has lower total height, considerably narrower profile and weighs significantly less than a two roll fuser with marginal stiffness.

In summary, there has been disclosed a three roll fuser which solves the problem of nonuniform nip load inherent in wide fuser rolls. To this end, a crowned roll member is supported for pressure engagement with the fuser roll such that the fuser roll is sandwiched between the crowned roll and a conventional pressure roll. By providing a crowned third roll supported in engagement with the fuser roll, in lieu of crowning the fuser roll of a two roll fuser, uniform nip load and speed are provided.

Because the diameters of the three rolls are relatively small, the total height of the stack of three rolls is actually equal to or less than the height of a conventional two roll system with adequately stiff rolls. The weight and width of the three roll fuser is considerably less than an equivalent two roll type fuser. Two rolls can't provide as uniform a load distribution without crowning or skewing the rolls which leads to nip velocity problems. The fuser roll diameters required in a two roll fuser make it more difficult to strip copies than with a three roll system where the roll diameters are significantly smaller. Also, the three roll fuser of the present invention allows selection of fuser roll diameters without regard to roll stiffness considerations.

While there has been illustrated and described what is at present considered to be a preferred embodiment of the present invention, it will be appreciated that certain changes and modifications are likely to occur to those skilled in the art, and it is intended in the appended claims to cover all those changes and modifications which fall within the true spirit and scope of the present invention.

What is claimed is:

1. Apparatus for fusing toner images to substrates, said apparatus comprising:

a relatively long heated fuser roll structure, said heated fuser roll structure having a uniform diameter and a length in the order of 24 to 36 inches;

a relatively long pressure roll structure supported for pressure engagement with said heated fuser roll to form a nip therebetween, said pressure roll structure having a uniform diameter and a length in the order of 24 to 36 inches;

means cooperating with said fuser and pressure rolls for effecting uniform pressure and velocity in said nip.

2. Apparatus according to claim 1 wherein said means for effecting uniform pressure and velocity in said nip comprises means for effecting deflection of said roll structures.

3. Apparatus according to claim 2 wherein said means for effecting uniform pressure and velocity in said nip comprises a crowned backup roll supported for pressure engagement with one of said roll structures.

4. Apparatus according to claim 3 wherein said crowned backup roll is supported in contact with said fuser roll structured.

5. Apparatus according to claim 4 wherein the degree of crowning of said backup roll is equal to the sum of the deflection of roll structures.

6. A method for fusing toner images to substrates, said method including the steps of:

providing a relatively long heated fuser roll structure having a uniform diameter and a length in the order of 24 to 36 inches;

supporting a relatively long pressure roll structure having a uniform diameter and a length in the order of 24 to 36 inches in pressure engagement with said heated fuser roll to form a nip therebetween;

effecting uniform pressure and velocity in said nip.

7. The method according to claim 6 wherein said step of effecting uniform pressure and velocity in said nip comprises means deflecting said roll structures.

8. The method according to claim 7 the step of effecting uniform pressure and velocity in said nip comprises supporting a crowned backup roll in pressure engagement with one of said roll structures.

9. The method according to claim 8 wherein said crowned backup roll is supported in contact with said fuser roll structured.

10. The method according to claim 9 wherein the degree of crowning of said backup roll is equal to the sum of the deflection of said roll structures.

11. Apparatus for fusing toner images to substrates, said apparatus comprising:

a relatively long heated fuser roll structure said heated fuser roll structure having a length in the order of 24 to 36 inches;

a relatively long pressure roll structure supported for pressure engagement with said heated fuser roll to form a nip therebetween, said pressure roll structure having a length in the order of 24 to 36 inches;

means for effecting deflection of said roll structures for effecting uniform pressure and velocity in said nip.

12. A method for fusing toner images to substrates, said method including the steps of:

providing a relatively long heated fuser roll structure having a length in the order of 24 to 36 inches;

supporting a relatively long pressure roll structure having a length in the order 24 to 36 inches in pressure engagement with said heated fuser roll to form a nip therebetween;

deflecting said roll structures for producing uniform pressure and velocity in said nip.

* * * * *